US008748768B2

(12) United States Patent
Bowers

(10) Patent No.: US 8,748,768 B2
(45) Date of Patent: Jun. 10, 2014

(54) METHOD AND SYSTEM TO INDICATE BIN SWEEP STATUS ON DOCUMENT PROCESSING EQUIPMENT

(75) Inventor: Brian Bowers, Mundelein, IL (US)

(73) Assignee: Bell and Howell, LLC, Durham, NC (US)

( * ) Notice: Subject to any disclaimer, the term of this patent is extended or adjusted under 35 U.S.C. 154(b) by 673 days.

(21) Appl. No.: 12/427,211

(22) Filed: Apr. 21, 2009

(65) Prior Publication Data

US 2009/0283453 A1 Nov. 19, 2009

Related U.S. Application Data

(60) Provisional application No. 61/054,007, filed on May 16, 2008.

(51) Int. Cl.
*B07C 5/00* (2006.01)

(52) U.S. Cl.
USPC ..... 209/584; 700/223; 700/227

(58) Field of Classification Search
USPC ..... 209/551, 583, 584, 900; 700/223–227
See application file for complete search history.

(56) References Cited

U.S. PATENT DOCUMENTS

| | | | | |
|---|---|---|---|---|
| 6,279,750 | B1 * | 8/2001 | Lohmann | 209/559 |
| 6,283,304 | B1 * | 9/2001 | Gottlieb et al. | 209/603 |
| 6,576,857 | B1 * | 6/2003 | De Leo et al. | 209/584 |
| 6,610,954 | B2 * | 8/2003 | Takizawa | 209/583 |
| 6,703,574 | B1 * | 3/2004 | Kechel et al. | 209/584 |
| 6,749,194 | B2 * | 6/2004 | Hanson et al. | 271/176 |
| 6,881,916 | B2 * | 4/2005 | McLaughlin et al. | 209/584 |
| 7,258,277 | B2 * | 8/2007 | Baker et al. | 235/385 |
| 7,390,986 | B2 * | 6/2008 | McDonald | 209/584 |
| 7,671,293 | B2 * | 3/2010 | Fry et al. | 209/584 |
| 7,741,575 | B2 * | 6/2010 | Bowers et al. | 209/584 |
| 7,834,289 | B2 * | 11/2010 | Orbke et al. | 209/584 |
| 7,923,655 | B2 * | 4/2011 | Quine et al. | 209/584 |
| 7,933,681 | B2 * | 4/2011 | Maitino | 700/224 |
| 2002/0139727 | A1 * | 10/2002 | Vanderbles et al. | 209/584 |
| 2006/0124513 | A1 | 6/2006 | McLaughlin et al. | |
| 2007/0000989 | A1 | 1/2007 | Kadaba | |
| 2008/0000817 | A1 * | 1/2008 | Kostyniuk et al. | 209/584 |
| 2009/0048704 | A1 * | 2/2009 | Redford | 700/224 |
| 2009/0139914 | A1 * | 6/2009 | Brandt | 209/584 |
| 2009/0216585 | A1 * | 8/2009 | Doyle | 705/7 |
| 2009/0287343 | A1 * | 11/2009 | Lee et al. | 700/227 |

FOREIGN PATENT DOCUMENTS

| | | | |
|---|---|---|---|
| EP | 1 084 770 | A | 3/2001 |
| EP | 1 561 601 | A | 8/2005 |
| EP | 1 655 080 | A | 5/2006 |
| WO | WO 2005/032732 | A1 | 4/2005 |

OTHER PUBLICATIONS

European Search Report issued in European Patent Application No. EP 09006544.2 dated Apr. 6, 2010.
European Search Report issued in European Patent Application No. EP 09 00 6544 dated Sep. 8, 2009.

* cited by examiner

*Primary Examiner* — Joseph C Rodriguez
(74) *Attorney, Agent, or Firm* — McDermott Will & Emery LLP

(57) ABSTRACT

The present application relates to a method and system for mail item processing. More particularly, the present application relates to a method and system alerting document processing operators when all mail items have reached a designated bin in order to improve accuracy and efficiency during document processing as well as improving the overall efficiency of the document processing facility.

10 Claims, 5 Drawing Sheets

METHOD AND SYSTEM TO INDICATE BIN SWEEP STATUS ON DOCUMENT PROCESSING EQUIPMENT

RELATED APPLICATIONS

This application claims the benefit of U.S. Provisional Application No. 61/054,007 Filed May 16, 2008 the disclosure of which is entirely incorporated herein by reference.

TECHNICAL FIELD

The subject matter discussed herein relates to a method and system for mail item processing, and particularly, a method and system for alerting an operator when all mail items expected for a given sort bin on a mail sorter have been seen.

BACKGROUND

Document processing facilities often use high speed document processing machines such as sorters, to sort and direct mail items appropriately to one or more mail bins for distribution. Various types or stages of processing may occur during sorting of the mail items as they are transported at high speeds along a transport path of the sorter via a system of mechanized pulleys, levers and rollers. Such processes may include, but are not limited to imaging of each mail item at various moments of transport, interpretation of address components (e.g., recipient addresses, ZIP codes, barcodes) based on the image as marked upon the mail items for enabling association of each mail item with a sort scheme, printing upon the mail item, application of labels, opening or cutting of the mail item, etc. Generally, these processes are coordinated by one or more computers operating in connection with the sorter. In a multi-sorter environment, where a mailing is distributed for processing amongst multiple sorters, a server may act as a central administrator of sorter activity—i.e., facilitating data exchange, managing job scheduling and processing, coordinating sort schemes amongst sorter devices, etc.

The common goal of any sort operation is to arrange a plurality of disparate mail items provided as input to the sorter into one or more bins in accord with postal authority standards. Generally, the postal grouping to which a mail item belongs and hence the sort bin to which it is ultimately directed to within the sorter, is based on the delivery point identifiers indicated upon the mail item. This may include things such as the ZIP Code designation, address data, etc. Other factors regarding the mail item, such as weight class or postage application may further affect how it is classified by the postal authority and hence delivered via the postal network. Regardless of classification, however, a single postal grouping and hence sort bin may include mail items possessing a plurality of delivery point identifiers or only one (e.g., one or more ZIP Code designations). Sort processing of disparate mail items into sort bins containing mail items having common postal authority recognized delivery point identifiers leads to increased postal processing and postal authority work sharing discounts. Objectively, it is desired that the sort processing required to yield the maximum work sharing discounts be done with as few passes—i.e., processing cycles—of the mail as possible.

Quite often, mail processing tasks must be distributed across multiple document processing devices, and in some instances, multiple differing mail processing environments entirely. For instance, a mailing may be created and originated by an inserting environment of a customer, but subsequently sort processed for mailing via the postal authority on behalf of that customer by a pre-sort bureau or other sort processing vendor. Alternatively, differing sort processing environments may share or co-mingle their mailings in an effort to produce maximum work sharing discount incentives for the participating parties. So, for example, a first sort processing environment may provide mail having certain delivery point identifiers upon it that increase the mail volume of a second sort processing environment, enabling the second sort processing environment to generate greater discounts, and vice versa.

Current sorting operations delay the final sweeping of bins until the last mail item has been processed, since there is no way to determine for a given sort bin on a sorter, whether the bin has received all of the mail items that will be sorted to that bin. This results in delay in starting the next processing run until all mail items from a previous run have been removed from the sorter. The sweeping accuracy is also impacted since the operator must complete the final sweep of the bins as fast as possible. Consequently, shipping dock efficiency within the document processing facility is also affected since less of the mail items necessary to complete a pallet for shipment arrive at the dock early. This forces the document processing facility to operate in a sequential manner that inhibits maximum use of its time and resources.

Therefore there exists a need for an improved system and method for alerting document processing operators when all mail items have reached a particular bin in order to improve accuracy and efficiency during document processing, as well as the overall efficiency of the document processing facility.

SUMMARY

It is desirable to provide a method for enhancing subsequent pass sorting operations at a mail sorting facility. The method includes determining a number of mail items expected at each of one or more bins by analyzing delivery point data associated with each of a plurality of mail items. The plurality of mail items are sorted to the one or more bins in accordance with the delivery point data. A count of mail items is maintained at each of the one or more bins when the plurality of mail items are sorted. An alert associated with a bin is triggered when the number of mail items expected at the bin is reached by the count of mail items at the bin.

It is further desirable to provide a mail processing system with an enhanced subsequent pass sorting operation. The system includes a server for receiving and processing mail data. The mail data includes at least delivery point data associated with each of the plurality of mail items. The server determines a number of mail items expected at each of one or more bins by analyzing the delivery point data associated with each of the plurality of mail items. At least one sorter is included for sorting the plurality of mail items to the one or more bins in accordance with the delivery point data. The sorter maintains a count of mail items for each of the one or more bins when the at least one sorter sorts the plurality of mail items to the one or more bins. A sorter triggers an alert associated therewith when the number of mail items expected at the bin is reached by the count of mail items at the bin.

Other concepts include a method for enhancing subsequent pass sorting operations at a mail sorting facility. The method includes determining a number of expected mail items directed to each of one or more bins in accordance with a sort scheme. The number of expected mail items is determined in advance of subsequent pass processing of a plurality of mail items using a sorter associated with the one or more bins. Delivery point data associated with each of the plurality of mail items is detected. The plurality of mail items are sorted in accordance the delivery point data to the one or more bins. A count of mail items is maintained at each of the one or more bins. A determination is made as to whether all the expected mail items have been received at a bin by comparing the number of expected mail items of the bin and the count of mail items received at the bin. An alert is set indicating that all mail items should be swept from the bin based on the determination.

Still further concepts include a method for enhancing subsequent pass sorting operations at a mail sorting facility. The method includes determining a check-off list of unique numbers for mail items expected at each of one or more bins by analyzing delivery point data and the mail item unique number associated with each of a plurality of mail items. The plurality of mail items are sorted to the one or more bins in accordance with the delivery point data. A record of mail item unique numbers is maintained at each of the one or more bins when the plurality of mail items are sorted. An alert associated with a bin is triggered when all of the mail item unique numbers expected for the bin have been processed and sorted to the respective bin.

Additional objects, advantages and novel features of the examples will be set forth in part in the description which follows, and in part will become apparent to those skilled in the art upon examination of the following and the accompanying drawings or may be learned by implementation or operation of the examples.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and software have been described at a relatively high-level, without detail, in order to avoid unnecessarily obscuring aspects of the present teachings.

As used herein, a "mail item" refers to any article having human or machine readable content generated thereon, and particularly intended for delivery to a given recipient. Mail items may include, but are not limited to, envelopes, newsletters, newspapers, magazines, post cards, parcels or packages of varying thicknesses (e.g., flat mail), coupon booklets, brochures, and other like documents. Such items may or may not be generated for the purpose of being distributed via an outgoing distribution channel (e.g., delivery company, postal authority), but rather, may be generated for direct/personal carry, private delivery, or internal distribution. The examples presented herein pertain to those intended for distribution via a postal authority, although skilled practitioners will recognize the other distribution channels may apply.

Figure 1:
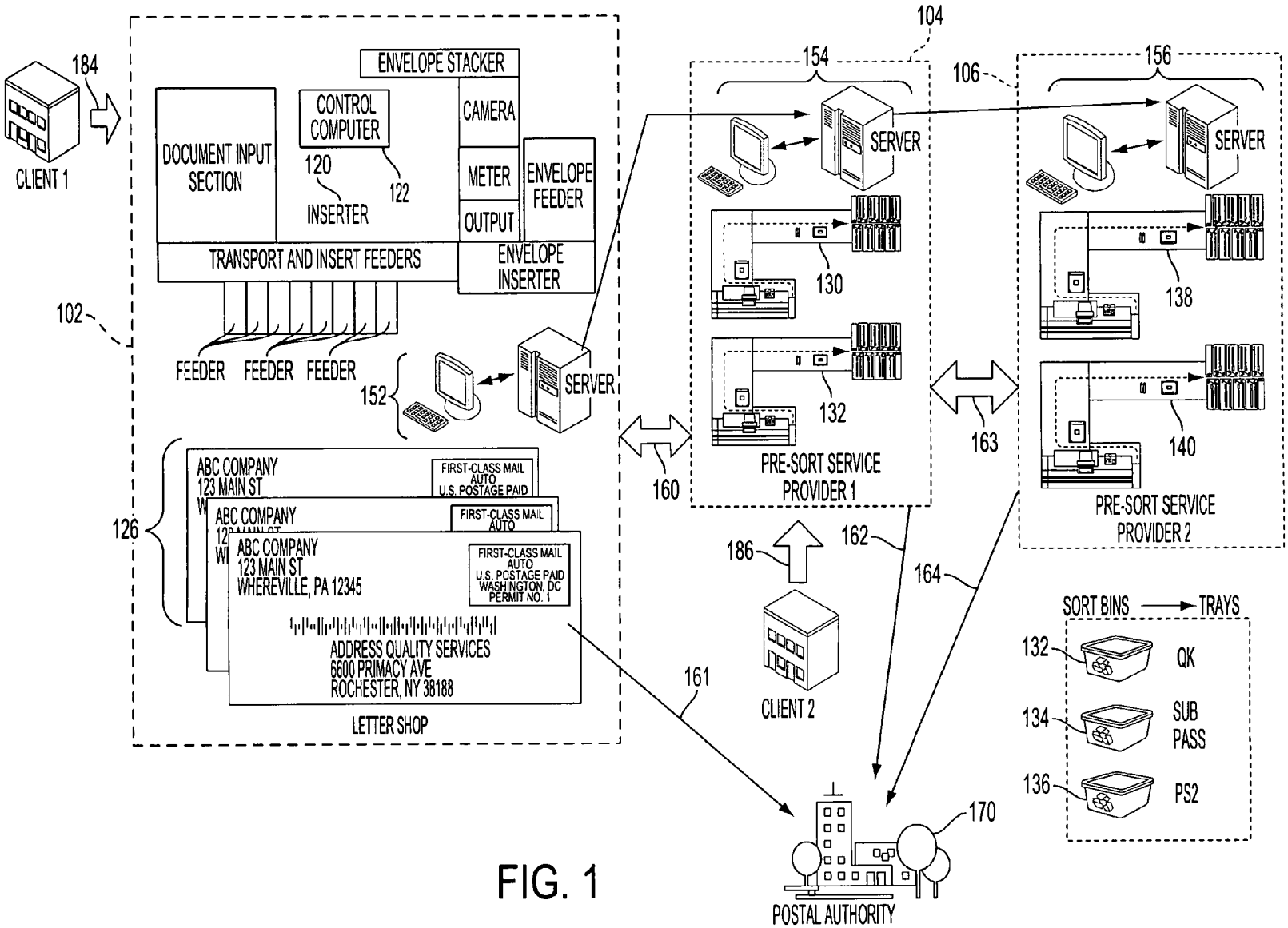
FIG. 1 illustrates the system components in a multi-device mail item processing environment.

With reference now to FIG. 1, one or more clients may wish to distribute mail items to a plurality of mail targets via a postal authority network 170, which may comprise one or more local or regional mail processing centers dispersed throughout a given geographic domain. For example, the United States Postal Service is the postal authority representative of the U.S. with thousands of mail processing centers, resources, people and associated rules and regulations for ensuring proper distribution of mail items. Client 1 184 in this example employs a letter shop 102 to manufacture its mail items 126 on an inserter 120. For this example the letter shop 102, upon performing the mail processing task as requested by Client 1 184, has some mail that is fully processed 161 and is compliant with postal authority 170 standards. This mail is referred to as quick kill mail items—i.e., mail requiring no further analysis, preparation or sortation to be presentable to a postal authority. Immediate segregation of such mail ensures its timely disbursement to the postal authority 170 and enables further sort analysis to be performed on only those mail items requiring it.

Even after processing the quick kills, the letter shop may still have additional mail items 160 that require additional processing by a sorter. While an inserter 120 may be useful for manufacturing and producing mail items in accord with the specifications of Client 1 184, a sorter may enable analysis and processing to be performed to enable effective grouping of mail items into postal authority approved sort groups. Hence, this mail 160 is transferred by the letter shop 102 to pre-sort service provider 104. In addition, data files pertaining to the mail items to be transferred—i.e., as maintained by the inserter control computer 122 or central server 152—are provided to the pre-sort service provider 104 server 154. This data contains a listing of all the delivery point identifiers for the mail items 160 that were transferred in addition to any other relevant item level data. The data transferred for the central server 152 will be used to determine subsequent pass sort schemes and will be used to aggregate delivery point data to determine bin counts or populate a "check-off" list. A delivery point identifier may include a recognized postal authority ZIP code designation—i.e., 5-digit, 9-digit or 11-digit for USPS. If the mail is being tracked with an intelligent mail barcode (IMB) or other postal authority approved code, the data associated with each mail item is also sent to the server 154 as part of the data file. More regarding the IMB as a particular type of postal authority approved will be discussed in future sections of the description. Suffice to say, receipt of the data files along with any specific sort processing instructions/demands of Client 1 184 or the Letter Shop 102, enables the Pre-sort Service Provider 104 to effectively coordinate and plan job execution in advance.

In a co-mingled or shared sortation environment, Pre-sort Service Providers 1 and 2 (104 and 106, respectively) will also share mail in order to qualify the mail items for greater discounts. Greater discounts are obtained in accordance with postal authority rules on the basis of mail volume and sort group segregation. By sorting mail items having postal authority approved delivery point identifiers into common sort groups, this minimizes the workload to be performed by the postal authority resulting in the granting of worksharing discounts. Consequently, to improve overall mail volume and sort group allocation possibilities, it is not uncommon for pre-sort service providers to exchange and/or trade some or all of their mail items. When this is the case, the mail items to be shared 163 are packaged into mail trays 136 and shipped to the other pre-sort service provider 106 accordingly. In addition, data files are sent to the server 156 of the receiving pre-sort service provider 106. This data contains a listing of all the delivery points for the mail items 163 that were physically transferred to the provider 106. Exemplary data formats may include, but is not limited to, MAIL.dat, comma delimited data files, custom job files, etc. If the mail is being tracked with an intelligent mail barcode, the data associated with each mail item is also sent to the server 156. Each of these pre-sort service providers 104 and 106 also have quick kill mail items 162, 164 that can be dispatched early to the postal authority or held on the shipping dock until all the mail items are ready to be shipped to the postal authority 170.

The non-quick kill mail for other sources 160, 163 needs to be processed on a subsequent pass through one or more sorters 130, 132, 138, 140 to achieve sortation that enables maximum postage discounts to be forthcoming. Each initial sorting operation (first pass) creates subsequent pass mail items that need additional sortation. These mail items are collected in trays 134 and combined with the mail items 160 and 163 that have been received from letter shop 102 or other pre-sort service providers and staged at a sorter 130 for subsequent pass sortation. The subsequent pass mail items 134 have data associated with them, including a listing of all the delivery points for the subsequent pass mail items 134. If the mail is being tracked with an intelligent mail barcode, the data associated with each mail item is also sent to the server 154. The data from multiple sources is combined by the servers 154 and 156 and processed accordingly.

Figure 4A:
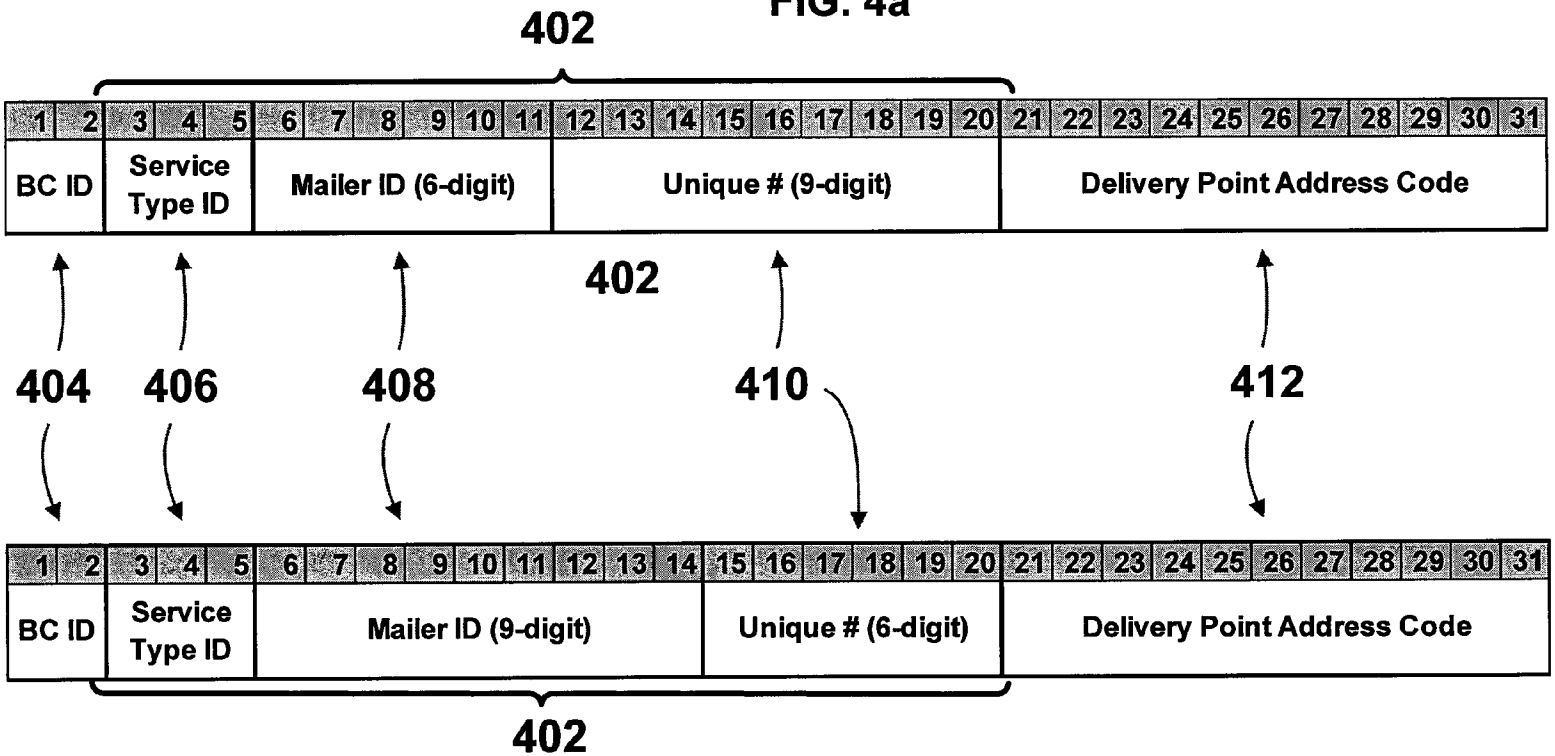
FIGS. 4*a*-4*b* depict an exemplary barcode data structure and barcode identifier capable of being applied to a mail item.
Figure 4B:
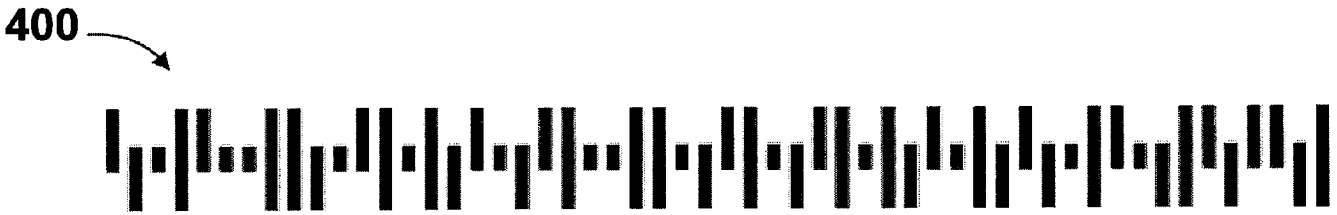

FIGS. 4*a*-4*b* depict an exemplary postal authority approved code in the form of a barcode that allows tracking of mail items destined for placement with a particular postal authority sort group. In particular, the exemplary barcode structure and type presented herein pertains to the Intelligent Mail Barcode (IMB) 400. Nonetheless, those skilled in the art will recognize that the IMB 400 is an exemplary postal authority approved code and does not limit the scope and application of the techniques and concepts presented herein. Furthermore, though presented herein with respect to a postal authority (e.g., USPS), the exemplary techniques described may be applicable to any mail item delivery service or carrier that may benefit from schemes to enable appropriate mail identification uniqueness. Indeed, any type of postal code, be it barcode based, alpha-numeric, graphical or other may be employed within the context of the examples herein.

The IMB 400 is a height modulated barcode that uses varying vertical bar types to encode data as shown in FIG. 4*a*. When used to qualify for automation discounts, the IMB can be placed in the address block or in the barcode clear zone, generally found on the lower right corner of a mail item. The IMB 400 is a 31-digit postal authority code, with fields for encapsulating various data as shown in FIG. 4*a*. As recognized by those skilled in the art, various barcode generation software tools, fonts and/or encoders may be used to generate the IMB in accord with postal authority requirements. Data fields comprising the IMB 400 include, but are not necessarily limited to: a two-digit barcode identifier 404, a three-digit service type identifier 406, a six or nine-digit mailer identifier 408 (MID), a nine or six-digit unique number 410, and a delivery point address code 412 that can be zero, five, nine or eleven-digits. The MID 408 when taken in combination with the unique number 410 and service type identifier 406 comprise an 18-digit Unique Identifier 402.

The mailer identifier (MID) 408 is generally defined and/or assigned by the postal authority based on the mailer's annual mail volume or other criteria. Generally, all 6-digit MIDs will begin with '0' through '8', while all 9-digit MIDs begin with '9'. The service type identifier 406 specifies a particular postal authority approved mail class and service(s) to be executed upon the mail item, such as First Class, Standard Mail, Periodicals, etc. in the case of the United States Postal Service (USPS). The delivery point address code 412 contains ZIP Code data of varying ranges (e.g., 5-digit ZIP versus 11-digit ZIP). The unique number 410 may be assigned at the discretion of the mailer, but must be certifiably unique for a period of time specified by the postal authority (e.g., 45 days for USPS). Various techniques for determining the uniqueness may be employed by the mailer for encoding as the unique number 410, including but not limited to: serializing the mail items, embedding Julian date parameters, embedding mailing event data, using recipient identifier data, using database or mailing record ID. Those skilled in the art will recognize however that such 'static' encoding techniques are limited in their usefulness considering the dynamic nature of mail processing, particularly within a single multiple document processing device environment, where a particular clients' mailing may be distributed across differing devices.

Figure 2:
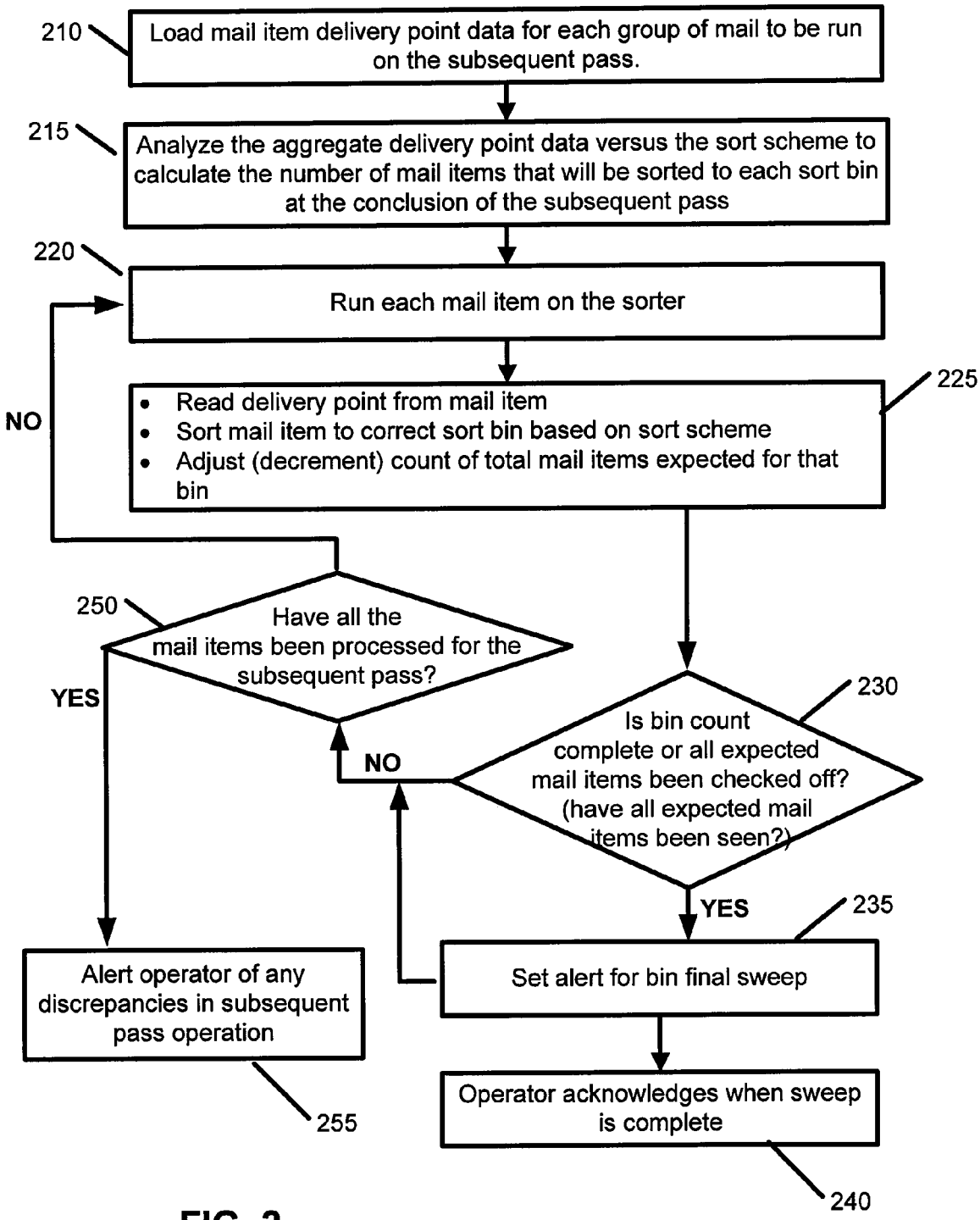
FIG. 2 is an exemplary flow chart depicting the steps to provide an alert for bin final sweep.

While various other details regarding the IMB may be emphasized, the discussion will proceed to FIG. 2, which presents an exemplary flowchart depicting the process by which the unique numbers may be allocated and assigned within a multiple document processing system environment to ensure uniqueness of mail items for a specified period of time. More specifically, the assigned unique number may be encoded within a postal authority code, such as the IMB, on the basis of a 6 or 9-digit mailer identifier 408 (FIG. 4*a*). Again, those skilled in the art will recognize that the IMB is only one of several types of present day and future postal authority code implementations suited for this purpose.

Turning now to FIG. 2, the processing steps are depicted. As indicated above, the data associated with all the mail items which are staged to be run on a given sorter 130 will be loaded into the server 154, step 210. Alternately the processing steps may be accomplished on the computer attached to the sorter 130. The aggregated data, from all sources that have contributed mail items for subsequent pass processing, identifies all of the delivery points (11-digit ZIPCODE for USPS) for each mail item to be processed. The subsequent pass has a sort scheme associated with the sorter operation. The sort scheme defines which mail items will be sorted to which of the sort bins on the sorter based on the delivery point printed on each mail item. The acceptable groupings of delivery points are defined by the postal authority. The total list of delivery points represented by the mail items to be processed is compiled to determine how many mail items will be sorted into each postal authority sort group based on the sort scheme. The total number of mail items that will be sorted to a particular sort bin on the sorter is also known since each postal authority sort group is assigned a unique bin number, Step 215. In addition, if the mail items are being tracked with a postal authority approved code (e.g., IMB), the data associated with each mail item can be associated with the sort bin that the mail item is expected to be sorted into. Since each mail item is identified by a unique number, the group of unique numbers expected at any given sort bin is known when the delivery point data was aggregated, Step 215. The list of unique numbers can be used as a "check-off" process each time an expected unique number is seen and continued until all unique numbers have been seen.

Once the expected counts for each bin is known, sorting operations may be started, step 220. In Step 225, the delivery point is read from each mail item and the mail item is sorted to the correct sort bin based on the delivery point and sort scheme. When a mail item is added to a sort bin, the count of mail items expected for that bin can be updated (e.g., decremented). Those skilled in the art may prefer to increment the count up to the expected maximum as an alternative. If the mail items are being individually tracked, the sorted mail item will be marked in the data that it has been processed. If the bin count goes to zero or is complete, or the "check-off" is completed step 230, then all of the expected mail items have been processed for that bin. Even though additional mail items have yet to be processed in relation to the totality of all mail items processed by the sorter, it is known that no more mail will be sorted to this particular bin having already performed precise accounting of all pieces. An alert is set, step 235 when the bin is ready for final sweep. Many forms of alert are possible, including but not limited to, flashing lights on the bin, a message on the bin display or a central status display often used to identify mail jam locations or the operator consol. When the operator sweeps the bin, they may press a button to trigger resetting of the alert, step 240.

If all the mail items have not been processed, step 250, the sorting operations continue, step 220. When operations for the subsequent pass are complete, since all the available mail items have been sorted, the operator is alerted, step 255. The operator display can be used to identify any processing discrepancies as to bins that did not receive all of the expected mail items, bins that received extra items and if mail item tracking is being used the individual mail items that are missing can be identified. Reports with similar data can be generated for record keeping and client feedback.

Figure 3:
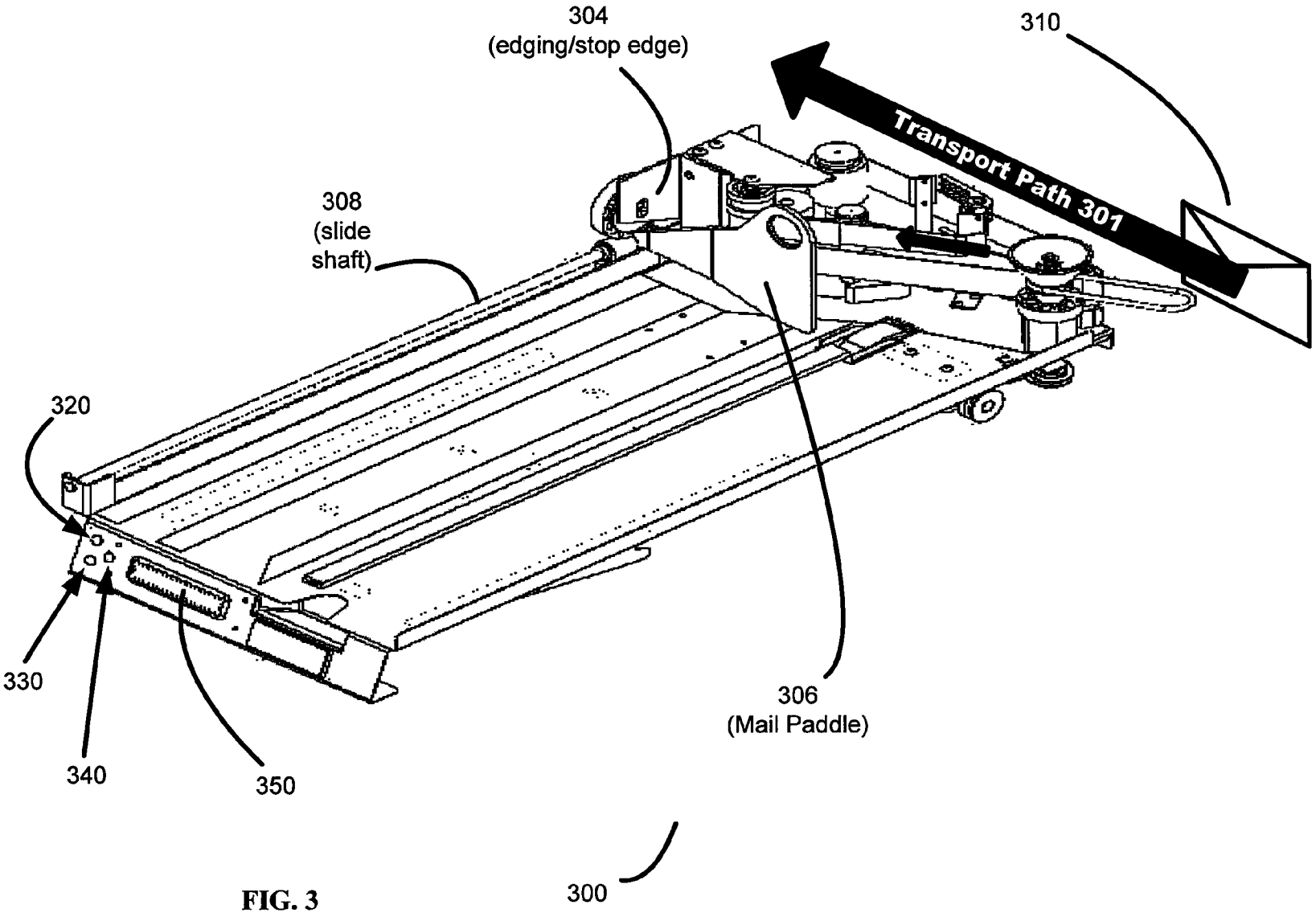
FIG. 3 depicts a mail bin having an indicator for alerting an operator of the status of a bin final sweep.

A modular arrangement of the elements of a mail bin for accumulating mail and providing an indication of bin sweep status is illustrated by way of example in FIG. 3. The mail bin 300 accumulates mail items 310 as they are directed and retrieved from along the transport path 301. A diverter (e.g., driven by a solenoid oriented along the transport path) shifts the transport direction of the mail item into the mail bin 300—as directed in accordance with the sort scheme/rule relative to that mail item—via a system of tightly engaged belts and pulleys. Ultimately, the mail item 310 is directed into the bin where it is met by the mail paddle 306. The leading edge of the mail piece is then guided to a side or stop edge 304, and the mail item is placed adjacent to the front plane of the mail paddle 306. As the number of mail items diverted to the mail pocket 301 grows, the mail paddle 306 shifts forward horizontally along a slide shaft 308 (maintained by a retractable tension device, such as a tension pulley—not shown). One or more sensors may be placed accordingly along the mail bin 200 to detect the movement and/or distance of the mail paddle 206 from an initial position, and consequently, to detect when the mail bin is filled to capacity (overflow) or partially (e.g., ⅔ full); corresponding to a indicator lights 330 and 320 respectively. An LCD display 350 may also indicate the number of mail items remaining before this particular mail bin 300 has all expected mail items to be processed. Finally, an acknowledgement button 340 may be resident upon the bin 300 for indicating a sweep by the operator and resetting the alert.

Still further, as the subsequent pass sort scheme data is known in advance, so too may pallet scheme generation data be generated in advance for the purpose of effectively arranging and coordinating a plurality of complete (full) bins into a pallet. In accord with the exemplary techniques described herein, bins triggered for sweep during a particular job run involving a plurality of mail items may then be palletized; the combination of one or more bins comprising a complete pallet. Those skilled in the art will recognize that the completion of a pallet may be achieved from the aggregation of bins involving a single sorter having multiple bins, or alternatively, from the aggregation of the bins from multiple sorters operating in connection with the formation of a pallet (e.g., a distributed sort processing environment). Hence, as bins are completed—i.e., an alert is triggered indicating they are full—it is conceivable that the bins necessary for a pallet may be arranged accordingly, prior to completion of or concurrent with the operation of one or more sorters as they process other mail items corresponding to a job.

Upon aggregation of the necessary bins, the pallet may be coordinated for delivery to a further processing center or submission to a postal authority and the server may be updated to acknowledge the current reduction in workload capacity. Having performed this task faster, unlike the traditional scenario requiring full completion of all bins before any palletization is performed, the mail processing facility may perform and updated coordination of human and capital resources, schedules, inventory needs, etc. against remaining or incoming mailing needs. Consequently, the mail processing facility may enhance its overall mailing capacity and mail submission needs.

As shown by the above discussion, aspects of the document processing environment and modules are controlled or implemented by one or more processors/controllers, such as one or more computers or servers. Typically, each such processor/controller is implemented by one or more programmable data processing devices. The hardware elements operating systems and programming languages of such devices are conventional in nature, and it is presumed that those skilled in the art are adequately familiar therewith.

Figure 5:
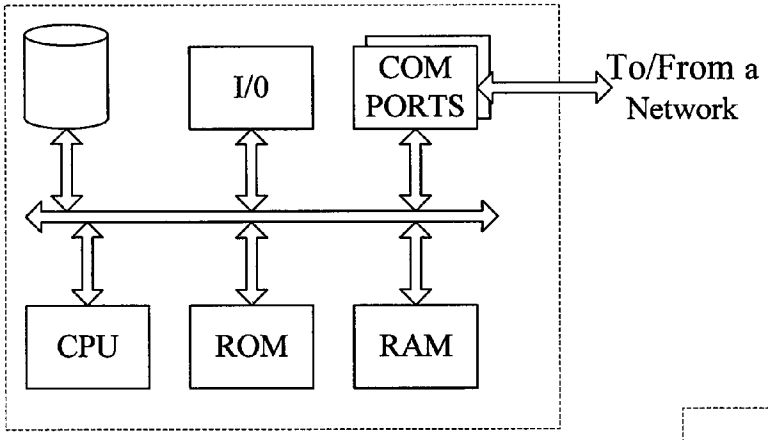
FIG. 5 illustrates a network or host computer platform, as may typically be used to implement a server.
Figure 6:
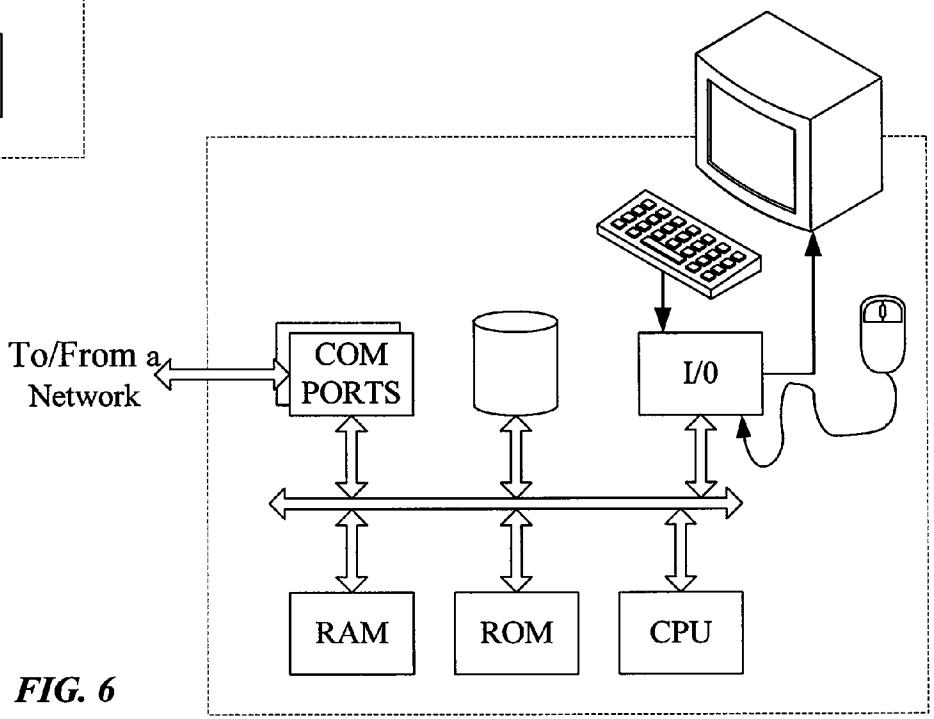
FIG. 6 depicts a computer with user interface elements.

FIGS. 5 and 6 provide functional block diagram illustrations of general purpose computer hardware platforms. FIG. 5 illustrates a network or host computer platform, as may typically be used to implement a server. FIG. 6 depicts a computer with user interface elements, as may be used to implement a personal computer or other type of work station or terminal device, although the computer of FIG. 6 may also act as a server if appropriately programmed. It is believed that those skilled in the art are familiar with the structure, programming and general operation of such computer equipment and as a result the drawings should be self-explanatory.

For example, the response computer 122 in FIG. 1 may be a PC based implementation of a central control processing system, or may be implemented on a platform configured as a central or host computer or server. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM, or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system trigger definitions and various application software as well as data, such as MIDs, histories, job data, target data, scripts, as discussed in detail above. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system components of FIG. 1 may include one or more input/output interfaces for communications. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, computer implementation may include a graphics subsystem to drive the output display. The output display, for example, may include a cathode ray tube (CRT) display, or a liquid crystal display (LCD) or other type of display device. Although not shown, a PC type system implementation typically would include a port for connection to a printer. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for processing (i.e. inserting or sorting) mail items.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art.

Hence aspects of the techniques discussed herein encompass hardware and programmed equipment for controlling the relevant mail processing and marketing activities as well as software programming, for controlling the relevant functions. A software or program product, which may be referred to as an "article of manufacture" may take the form of code or executable instructions for causing a computer or other programmable equipment to perform the relevant data processing steps regarding mail item tracking or processing and triggering the marketing actions, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide storage at any time for the software programming. All or portions of the software may at times be communicated through the Internet or various other telecommunication networks. Such communications, for example, may enable loading of the software from one computer or processor into another, for example, from a management server or host computer. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer (s) or the like, such as may be used to implement the sorting control and attendant mail item tracking based on unique mail item identifier. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed:

1. A mail processing system comprising:

a processor for receiving and processing mail data, wherein the mail data, obtained during a first pass sorting operation, includes at least delivery point data and a unique number associated with each of the plurality of mail items, and wherein the processor determines a listing of mail item unique numbers for mail items expected at each of a plurality of bins for a subsequent sorting pass by analyzing the delivery point data and mail item unique number associated with each of the plurality of mail items; and at least one sorter for sorting the plurality of mail items, during a subsequent pass sorting operation, to the bins in accordance with the delivery point data, wherein:

the sorter maintains a count of mail items sorted to each bin when the at least one sorter sorts the plurality of mail items to the bins, the sorter maintains a record of the mail item unique numbers at each of the one or more bins when the plurality of mail items are sorted, the sorter triggers an alert associated therewith when the number of mail items expected at one of the bins is reached by the count of mail items sorted to the one bin, each of the bins accumulates mail items and includes a display for displaying the incremental or decremental count of mail items received therein or to be received therein, respectively, relative to the number of mail items expected at each bin, such that an operator can visually inspect the decremental or incremental count for each bin, and the sorter generates a report indicating a discrepancy between the unique mail item numbers expected at each bin and the unique mail item numbers received at each bin.

2. The system of claim 1, wherein each of the one or more bins includes a diverter for directing a mail item in accordance with a sort scheme.

3. The system of claim 1, wherein the mail accumulating module further includes a mail paddle for detecting an accumulation of mail items received at each of the one or more bins and one or more sensors for detecting a position of the mail paddle, and wherein the position of the mail paddle is indicative of the count of mail items.

4. The system of claim 1, wherein each of the one or more bins further includes an acknowledgement device for an operator to acknowledge the alert and deactivate the alert after the operator sweeps all sorted mail items from the bin.

5. The system of claim 1, wherein the data received by the processor is generated by either a mail inserter system or a mail sorter system.

6. A mail processing method, the method comprising steps of:

receiving and processing mail data by a processor, wherein the mail data, obtained during a first pass sorting operation, includes at least delivery point data and a unique number associated with each of the plurality of mail items, and wherein the processor determines a listing of mail item unique numbers for mail items expected at each of a plurality of bins for a subsequent sorting pass by analyzing the delivery point data and mail item unique number associated with each of the plurality of mail items; and sorting the plurality of mail items on at least one sorter, during a subsequent pass sorting operation, to the bins in accordance with the delivery point data, wherein:

the sorter maintains a count of mail items sorted to each bin when the at least one sorter sorts the plurality of mail items to the bins, the sorter maintains a record of the mail item unique numbers at each of the one or more bins when the plurality of mail items are sorted, the sorter triggers an alert associated therewith when the number of mail items expected at one of the bins is reached by the count of mail items sorted to the one bin, each of the bins accumulates mail items and includes a display for displaying the incremental or decremental count of mail items received therein or to be received therein, respectively, relative to the number of mail items expected at each bin, such that an operator can visually inspect the decremental or incremental count for each bin, and the sorter generates a report indicating a discrepancy between the unique mail item numbers expected at each bin and the unique mail item numbers received at each bin.

7. The method of claim 6, wherein each of the one or more bins includes a diverter for directing a mail item in accordance with a sort scheme.

8. The method of claim 6, wherein the mail accumulating module further includes a mail paddle for detecting an accumulation of mail items received at each of the one or more bins and one or more sensors for detecting a position of the mail paddle, and wherein the position of the mail paddle is indicative of the count of mail items.

9. The method of claim 6, wherein each of the one or more bins further includes an acknowledgement device for an operator to acknowledge the alert and deactivate the alert after the operator sweeps all sorted mail items from the bin.

10. The method of claim 6, wherein the data received by the processor is generated by either a mail inserter system or a mail sorter system.

* * * * *